US006370726B1

(12) United States Patent
Kini et al.

(10) Patent No.: US 6,370,726 B1
(45) Date of Patent: Apr. 16, 2002

(54) DYNAMIC TOOTHBRUSH

(76) Inventors: Lata R Kini; Ramanand M Kini, both of 1596 La Rossa Cir., San Jose, CA (US) 95125

( * ) Notice: Subject to any disclaimer, the term of this patent is extended or adjusted under 35 U.S.C. 154(b) by 0 days.

(21) Appl. No.: 09/502,484

(22) Filed: Feb. 11, 2000

(51) Int. Cl.[7] ..... A46B 9/04
(52) U.S. Cl. ..... 15/167.1; D4/104
(58) Field of Search ..... 15/167.1; D4/104, D4/107, 132

(56) References Cited

U.S. PATENT DOCUMENTS 1,981,657 A * 11/1934 Miller
2,209,173 A * 7/1940 Russell
5,799,353 A * 9/1998 Oishi et al.
D422,143 S * 4/2000 Beals et al.
D425,306 S * 5/2000 Beals et al.

* cited by examiner

*Primary Examiner*—Terrence R. Till

(57) ABSTRACT

An improved toothbrush which has V-shaped ripples at the right and left side of the bristle field and the front surface of the bristle field is uniformly convex from the right side to the left side, without any ripples. Since the V-shaped ripples are located at the sides, the bristles in the V-shaped ripples can be packed and pushed deep inside the interdental spaces cleaning them thoroughly and at the same time cleaning and massaging the gingivae uniformly without exerting excessive pressure on the gingivae.

1 Claim, 4 Drawing Sheets

DYNAMIC TOOTHBRUSH

STATEMENT REGARDING FEDERALLY SPONSORED RESEARCH OR DEVELOPMENT

Not Applicable.

REFERENCE TO MICROFICHE APPENDIX

Not Applicable.

BACKGROUND OF THE INVENTION

The present invention relates to a toothbrush. Regular brushing of teeth is essential for maintaining good oral hygiene. The main objective of brushing is to remove plaque and food debris from the surfaces of the teeth, the gingivae and to simulate or massage the gingivae. While brushing the facial surfaces, it is desirable to clean the facial interdental areas, the facial surfaces of the teeth and the facial gingiva all at the same time. Similarly, while cleaning the lingual surfaces, it is desirable to clean the lingual interdental areas, lingual surfaces of the teeth and the lingual gingiva all at the same time. Interdental are are difficult to clean without exerting excessive pressure on the gingivae. Interdental spaces and the interdental gingivae are V-shaped and are best cleaned by V-shaped ripples designed in the bristles of the toothbrush.

CROSS-REFERENCE TO A RELATED APPLICATION

In the prior art toothbrushes which have ripples, the ripples are located on the front surface. They have a limited practical application in their ability to clean the interdental areas and clean and massage the gingivae at the same time without exerting excessive pressure on the gingivae. U.S. Pat. No. 2186005 issued Jan. 9, 1940 discloses a toothbrush in which ripples are located on The front surface, the tufts of bristles are arranged in a circular manner with a hollow in The center.

German Patent No. DE4010671A1 issued Aug. 23, 1990 and U.S.Pat. No. 1981657 issued Nov. 20, 1934 discloses toothbrushes which have triangular shaped right side and left side tufts of bristles but the apex of the triangular tufts are not pointing towards the sides and hence the bristles do not give characteristic V-shaped ripples to the right side and left side of the bristles as seen in the present invention

BRIEF DESCRIPTION OF THE INVENTION

With foregoing in mind, one of the objectives of the present invention is to pack the interdental spaces with large number of bristles without exerting excessive pressure on the gingivae so that the bristles can be pushed deep into the interdental space and thus can clean the interdental areas thoroughly. Another objective of the present invention is to clean the interdental areas and to clean and massage the gingivae uniformly all at the same time, for example—while cleaning the facial surface of the teeth; the facial interdental areas, the facial surface of the teeth and the facial gingiva all are cleaned at the same time without excessive pressure on the gingivae.

In the present invention, the V-shaped ripples are located at the right side and left side of the bristle field leaving the front surface of the bristle field without any ripples, instead the front surface is uniformly convex from the right side to the left side. Since the V-shaped ripples are located at the sides and the front surface is uniformly convex, the bristles can be packed and pushed into the interdental spaces from the sides without exerting excessive pressure on the gingivae thus acheiving thorough cleaning of the interdental areas and at the same time cleaning and uniformly massaging the gingivae. All this is acheived by a single brush movement i.e. placing the bristles at an angle at the junction of the gingiva and the tooth and aligning the V-shaped ripples into the interdental spaces and moving the bristles towards the occlusal surface of the teeth. When compared to the prior art toothbrushes, the present invention cleans the interdental areas more thoroughly and more conveniently.

LIST OF REFERENCE NUMERALS UTILIZED IN THE DRAWINGS

24—The improved toothbrush.
25—The handle of the improved toothbrush.
26—Neck of the improved toothbrush.
27—Head of the improved toothbrush.
28—Brush bed.

29—Right side of the brush bed.
30—Left side of the brush bed.
31—Top end of the brush bed.
32—Bottom end of the brush bed.
33—Front surface of the brush bed.
34—Back surface of the brush bed.
35—Apex of the triangular tuft of bristles.
36—Base of the triangular tuft of bristles.
37—Right side tufts of bristles.
38—Left side tufts of bristles.
39—Central tufts of bristles.
40—Top end of the bristle field
41—Bottom end of the bristle field.
42—Right side of the bristle field.
43—Left side of the bristle field.
44—Front surface or the working surface of the bristle field.
45—V-shaped ripples.
46—Facial interdental space.
47—Lingual interdental space.
48—Occlusal surface.
49—Facial surface of the teeth.
50—Facial gingiva.
51—Lingual surface of the teeth.
52—Lingual interdental gingiva.
53—Facial interdental gingiva.
54—Lingual gingiva.
55—Proximal surface of the teeth.
57—Arrow indicating the direction of the movement of the toothbrush.

DETAILED DESCRIPTION

Figure 1:
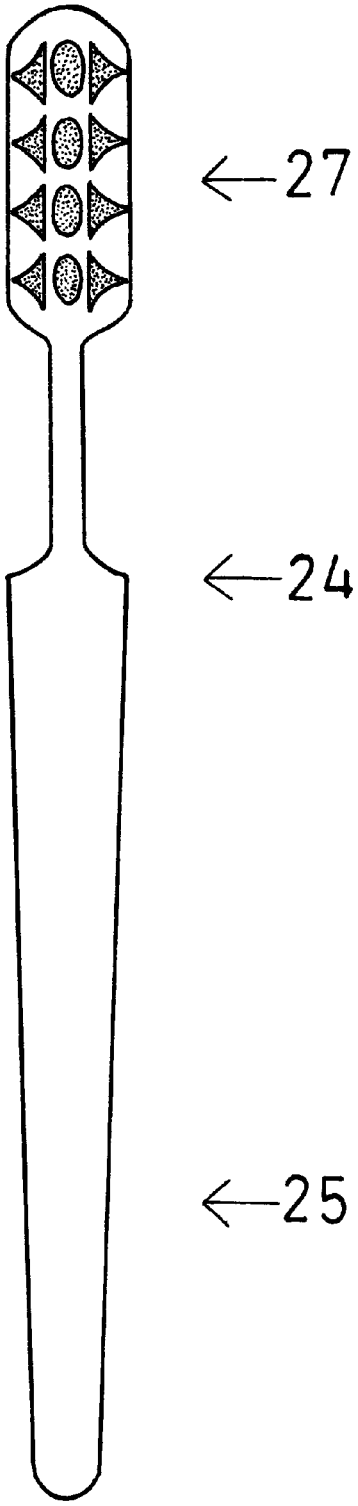
FIG. 1 is a back elevational view of the improved toothbrush constructed in accordance with the present invention. The toothbrush bed made of transparent plastic or similar material showing the embedded tufts of bristles.
Figure 2:
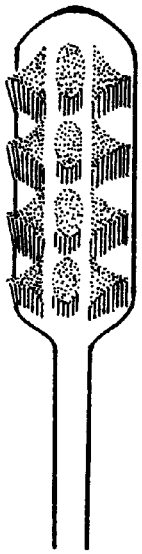
FIG. 2 is a front elevational view of the improved toothbrush.
Figure 3:
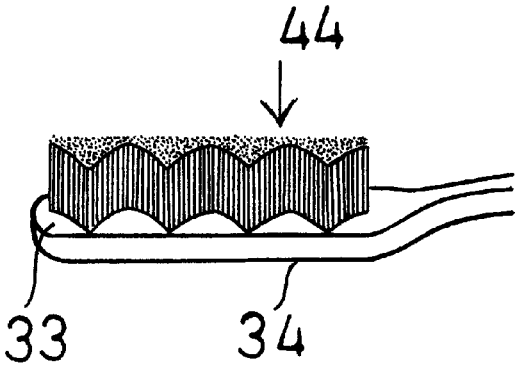
FIG. 3 is a side elevational view of the improved toothbrush.
Figure 4:
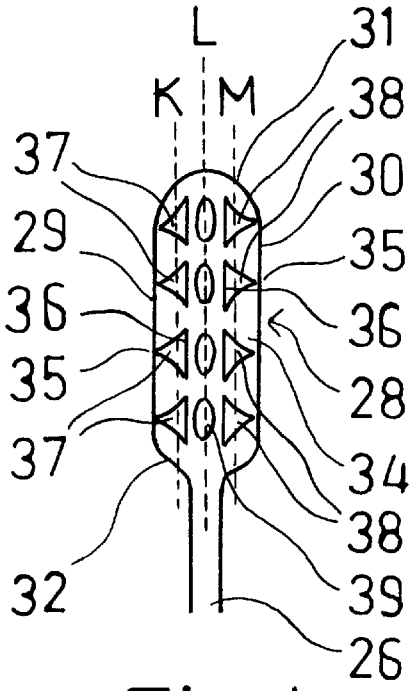
FIG. 4 is a schematic view of the back elevation of the improved toothbrush.
Figure 5:
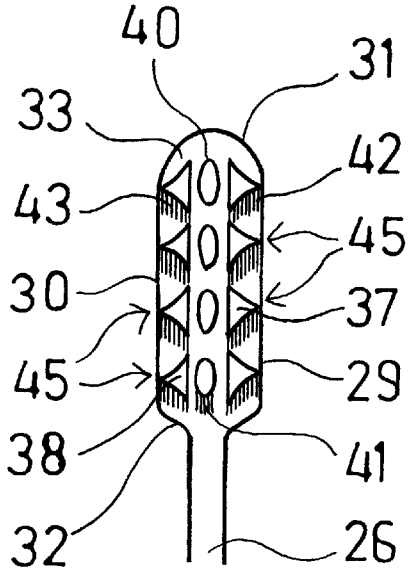
FIG. 5 is a schematic view of the front elevation of the improved toothbrush.
Figure 6:
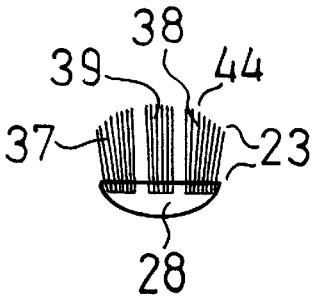
FIG. 6 is a top end elevational view of the improved toothbrush.

Refering more specifically to the drawings, the improved toothbrush broadly identified by the numeral 24 is illustrated in FIG. 1. The toothbrush 24 consists of a handle 25, a neck 26 and a head 27. The head 27 consists of a brush bed 28 which is substantially rectangular in shape, has a right side 29, a left side 30, top end 31, bottom end 32, front surface 33 and a back surface 34 as illustrated in FIG. 4 and FIG. 5. The bristles of the brush are grouped into tufts and are embedded in the brush bed 28 as shown in FIG. 6. The bristles emerge from the brush bed 28 to form a bristle field 23 as shown in FIG. 6. As shown in FIG. 1 and FIG. 4, the tufts are arranged in four rows and three columns, although a greater or lesser number of such rows may be employed. The tufts of bristles are made of plastic or natural bristles. The bristles of the tufts which create a bristle field 23, has a right side 42, a left side 43, top end 40 and a bottom end 41, which corresponds respectively with the right side 29, left side 30, top end 31 and bottom end 32 of the brush bed 28 as shown in FIG. 5. The tufts of bristles are arranged in three columns identified by alphabets K for the right side column, M for the left side column and L for the central column as illustrated in FIG. 4. The tufts in the column K are identified by the numeral 37, the tufts in column M are identified by numeral 38 and the tufts in column L are identified by numeral 39 as illustrated in FIG. 4. Each tuft 37 in column K is triangular in shape with apex 35 of each triangular tuft 37 facing the right side 29 of the brush bed 28, the base 36 of each triangular tuft 37 facing the central tufts 39 as shown in FIG. 4. Similarly, each tuft 38 of the column M is triangular in shape with apex 35 of each triangular tuft 38 facing the left side 30 of the brush bed 28 and the base 36 of each triangular tuft 38 facing the central tuft 39 as shown in FIG. 4.

The right side tufts 37 and the left side tufts 38 give V-shaped ripples 45 to the right side 42 and the left side 43 of the bristle field respectively as shown in FIG. 5.

Figure 8:
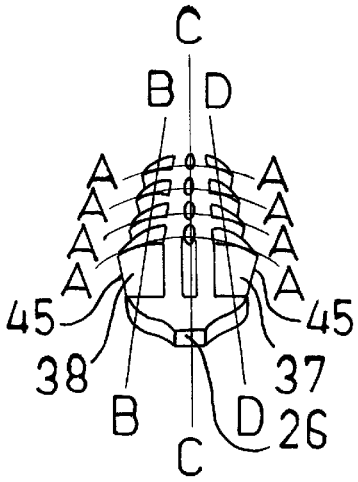
FIG. 8 is a schematic view of the front elevation of the improved toothbrush, showing geometrically the lay, form and development of the working point of the improved toothbrush.
Figure 7:
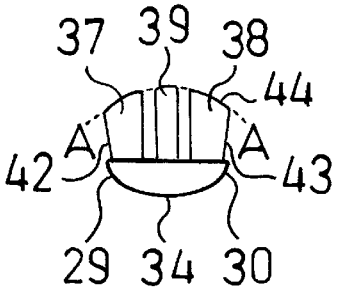
FIG. 7 is a schematic view of the top end elevation of the improved toothbrush.
Figure 9:
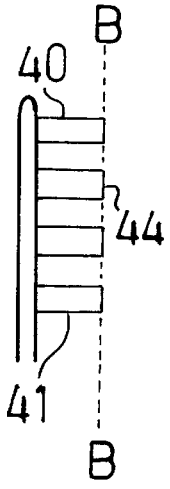
FIG. 9 is a sectional view taken along the line BB.
Figure 10:
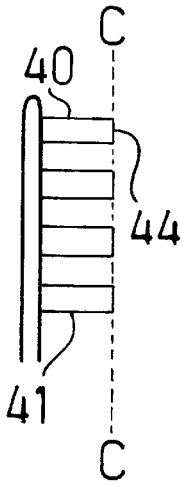
FIG. 10 is a sectional view taken along the line CC.
Figure 11:
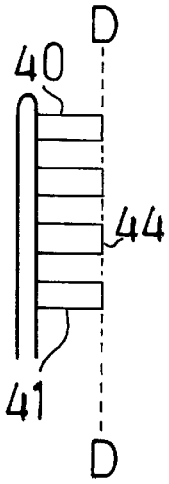
FIG. 11 is a sectional view taken along the line DD.
Figure 12:
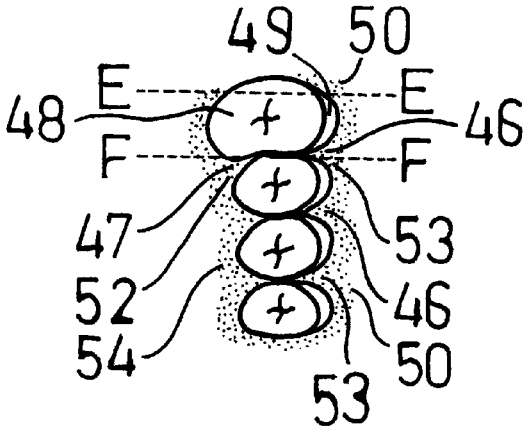
FIG. 12 is a schematic view of a lower left arch with the teeth.

The free end of the bristles which make the front surface 44, also is the working end of the bristles. The front surface 44 is convex from the right side 42 to the left side 43 of the bristle field as indicated by the curve AA in FIG. 7 & FIG. 8. The front surface 44 is straight from the top end 40 to the bottom end 41 of the bristle field as indicated by line BB, CC and DD in FIG. 8, FIG. 9, FIG. 10 & FIG. 11. The front surface 44 of the bristle field 23 is uniformly convex from right side 42 to left side 43 of the bristle field without any ripples.

Figure 15:
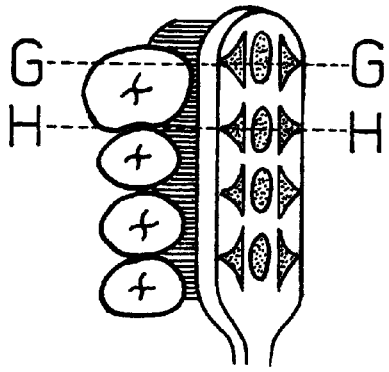
FIG. 15 is a schematic view of the improved toothbrush placed on the teeth and the gingivae, aligning the V-shaped ripples with interdental spaces during brushing.
Figure 13:
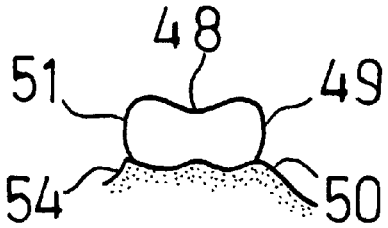
FIG. 13 is a sectional view taken along the line EE.
Figure 16:
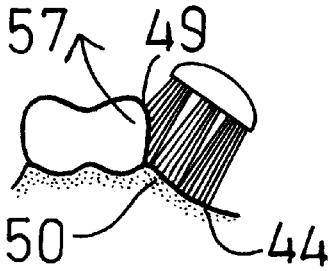
FIG. 16 is a sectional view taken along the line GG showing how the bristles clean the facial surface of the tooth and clean and massage the facial gingiva at the same time while the brush is moved in the direction of the arrow 57.
Figure 14:
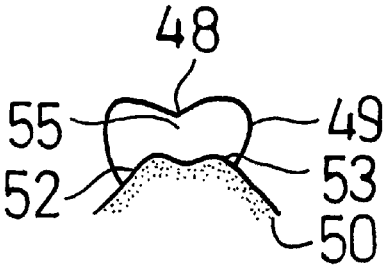
FIG. 14 is a sectional view taken along the line FF.
Figure 17:
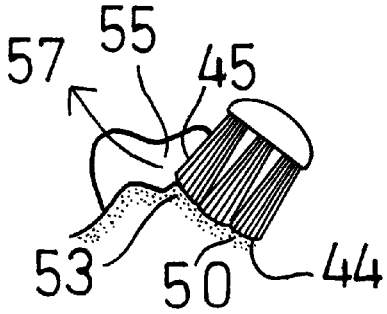
FIG. 17 is a sectional view taken along the line HH showing how the bristles in the V-shaped ripples go deep into the interdental space packing large number of bristles into the space and clean the facial interdental gingiva, proximal surfaces of the teeth and the facial gingiva at the same time without exerting excessive pressure on the gingivae when the brush is moved in the direction of the arrow 57.

The advantage of the novel working point, that is how the bristles in the V-shaped ripple can be packed in the interdental space without exerting excessive pressure on the gingivae is illustrated from FIG. 12 through FIG.17. For example, while brushing the facial side of the lower left arch, the brush is placed at an angle on the teeth and gingiva, the V-shaped ripple is aligned with the interdental space 46 as shown in FIG. 15, FIG. 16 & FIG. 17 and gentle pressure is applied when the brush is moved in the direction of the arrow 57. While brushing this way, large number of bristles are packed in the interdental space 46 increasing the bristle pressure and pushing the bristles deep into the interdental space 46 as shown in FIG. 17 and thus cleaning the facial interdental areas like the facial interdental gingiva 53, proximal surfaces of the teeth 55 thoroughly and at the same time cleaning and massaging the facial gingiva 50 without exerting excessive pressure on the facial interdental gingiva 53 and the facial gingiva 50. Similarly, the lingual side is cleaned by placing the brush on the lingual side. In this way, each arch or quadrant is cleaned i.e. the right lower, the right upper, the left lower and the left upper and the front teeth.

If the V-shaped ripples can not be aligned with all the interdental spaces in the arch or the quadrant, then each interdental space is aligned by one of the V-shaped ripples and is used as illustrated earlier. In this way, one by one or as many interdental spaces that can be aligned with the V-shaped ripples, is/are cleaned thoroughly without exerting excessive pressure on the gingivae as mentioned earlier, until all the interdental spaces are cleaned.

The present invention as described above is a hand held manual tooth brush in which we are seeking patent for only the head of the toothbrush with a novel working point of the bristles, therefore if desired, the size and shape of the neck and the handle of the toothbrush can be changed. Also, only the head with the novel working point of the bristles and the neck can be manufactured as a single unit to be attached to a handle which contains a mechanical device which produces sonic waves.

While there has been shown and described a preferred embodiment of the improved toothbrush, it is understood that changes in structure, materials, shapes and sizes can be made by those skilled in the art without departing from the invention The invention is defined in the following claim.

We claim:

1. An improved toothbrush which consists of a handle, a neck and a head, said head consists of a brush bed which is substantially rectangular in shape which has a front surface, a back surface, a right side, a left side, a top end and a bottom end, the bristles grouped as tufts are arranged in four rows and three columns and are embedded in said brush bed, as said bristles emerge from said brush bed, they form a bristle field which has a right side, a left side, a top end, a bottom end and the free end of said bristles makes the front surface, said three columns of tufts consist of a left side column, a right-side column and a central column, each tuft in said right side column and said left side column are triangular in shape, the apex of each said right side triangular tuft faces said right side of the brush bed and similarly the apex of each said left side triangular tuft faces said left side of the brush bed and gives V-shaped ripples to said right side of the bristle field and said left side of the bristle field, said front surface of the bristle field is in a straight plane from said top end of the bristle field to said bottom end of the bristle field, said front surface of the bristle field is convex from said right side to said left side of the bristle field.

* * * * *